United States Patent [19]

Rosato et al.

[11] Patent Number: 4,735,024

[45] Date of Patent: Apr. 5, 1988

[54] CONSTRUCTION OF AN ARENA FLOOR ADAPTED TO SELECTIVELY RAISE AND LOWER

[75] Inventors: Raymond N. Rosato, West Chicago; Erich M. Mees, LaGrange, both of Ill.

[73] Assignee: Deegan & Rosato Construction Co., Rosemont, Ill.

[21] Appl. No.: 933,474

[22] Filed: Nov. 21, 1986

[51] Int. Cl.[4] ..... F04F 15/024

[52] U.S. Cl. ..... 52/126.6; 52/7

[58] Field of Search ..... 52/126.6, 126.5, 7

[56] References Cited

U.S. PATENT DOCUMENTS

| | | | |
|---|---|---|---|
| 3,067,843 | 12/1962 | Rushtoh | 52/263 |
| 4,438,610 | 3/1984 | Fifer | 52/126.6 |
| 4,621,468 | 11/1986 | Likozar | 52/126.6 |
| 4,631,879 | 12/1986 | Kobayashi | 52/126.6 |

*Primary Examiner*—John E. Murtagh

*Attorney, Agent, or Firm*—Laff, Whitesel, Conte & Saret

[57] ABSTRACT

A combination comprising a movable floor for arenas or the like adapted to be elevated or lowered by lifting elements above the level of a stationary base floor, a plurality of first box-like framing elements having lifting brackets and beam elements interconnected to form a grid pattern throughout the movable floor structure, the lifting elements being supported in a plurality of second box-like framing elements embedded in a base floor beneath the movable floor. Flooring sections made preferably of concrete extend between the beam elements and first box-like framing elements to complete the movable floor structure. The lifting elements each include a vertically extending threaded shaft upon which a horizontally extending lifting plate is removably mounted. The lifting plate extends beneath the lifting brackets attached to the first box-like framing elements. The grid construction of the movable floor permits lifting forces to be carried around a first box-like framing element through adjacent beams to adjacent box-like framing elements and lifting brackets in the happenstance that one lifting element fails.

24 Claims, 5 Drawing Sheets

CONSTRUCTION OF AN ARENA FLOOR ADAPTED TO SELECTIVELY RAISE AND LOWER

The present invention pertains to the construction and operation of a movable floor structure, and more particularly to the construction and operation of a heavy movable arena floor which is capable of being elevated or lowered relative to a base floor upon which the movable floor of the arena is constructed.

BACKGROUND OF THE INVENTION

In many communities throughout the country, in recent years, arenas, stadia, sports facilities and convention centers have been constructed which are used to stage indoor athletic, amusement, and special events such as soccer matches, horse shows, musical concerts, basketball and hockey games, circuses, trade shows, expositions, and the like. Arenas of the type referred to herein are normally designed to seat thousands of spectators in tiered seats arranged in an oval or rectangular array around the active or playing floor of the arena.

In a typical arena construction, the active or playing floor is situated at a level, sometimes five to six feet, below the level of the first row of tiered seats circumscribing the arena floor. A vertical wall normally extends upward from the floor to the level of the first row of seats, and this wall encloses and defines the outer edges of the arena floor.

When an event takes place in the arena which uses only a partial portion of the arena floor, such as a basketball game, temporary tiered bleacher-type seats are constructed on the portion of the arena floor extending between the edge of the basketball court and the vertical rising wall located adjacent the lowermost row of permanent seats. These temporary seats extend downward to the arena floor as an apparent extension of the permanent tiers of seats, and provide preferred seating at close-to-playing-floor level for events such as basketball games, gymnastics events, or the like.

However, these arenas also host athletic and other events which occupy the entire floor area of the arena, such as a soccer match, where no seating can be placed beyond the lowermost row of the permanent seats which are located above the vertical wall encircling the playing area. It has been determined that in soccer matches, for example, a fair amount of the action of the game takes place in the corners of the playing field, which corners are out of the line of sight of many spectators due to the fact that the playing floor is located five or six feet below the last row of seats, and the fact that the playing area is surrounded by a five to six foot high wall. As a result, many of the seats in the arena cannot be sold for these events, since the sight lines extending from these seats to the corners of the playing field are obstructed, thereby preventing the occupants of these seats from enjoying some of the more important and exciting action of the game. To provide greater economic benefit to the promoters of the event staged in the arena, it is apparent that the creation of an arena design that will eliminate these blind seats would be most desirable.

Therefore, it is an object of the present invention to provide a construction for an arena of the type described wherein all seats provide a direct and unobstructed view of substantially all areas of the floor on which an athletic or special event is taking place.

Another object of the present invention is to provide a floor for an arena of the type described, which floor can be selectively elevated or lowered to vary the height of the active surface of the arena relative to the level of seats in the arena.

A further object of the present invention is to construct a floor for an arena which is simultaneously capable of being selectively elevated above the level of a base floor, and of supporting large loads, such as the weight of two complete socce teams moving rapidly across the elevated arena floor.

Yet another object of the present invention is to provide a construction for a movable arena floor which distributes heavy lifting loads evenly across a broad expanse of floor, while accommodating load transfer to adjacent flooring sections and lifting mechanisms in the case of failure of a lifting mechanism.

A further object of the present invention is to provide an apparatus for synchronously controlling the elevating and lowering of a heavy arena floor such that all points in the floor are raised or lowered in unison or individually to prevent buckling or cracking of the floor, depending upon varying load factors across the width of the floor.

Yet another object of the present invention is to provide a novel construction for a plurality of load bearing and transfer elements embedded in a movable arena floor and in an adjacent base floor to enable the movable floor to support substantial loads while in an elevated position.

SUMMARY OF THE PRESENT INVENTION

These and other objects of the present invention are provided in a preferred embodiment of the present invention wherein the base floor of an arena is provided with a plurality of lifting elements having heavy load capabilities and arrayed in a grid pattern beneath a movable floor which is adapted to be elevated and lowered by the lifting elements. In the preferred embodiment, the lifting elements comprise motor driven mechanical screw jacks. However, other suitable hydraulic, pneumatic, or other lifting elements of corresponding load bearing qualities and operational parameters may be utilized in place of the mechanical lifting elements illustrated herein. The control of each of the lifting elements is synchronized and coordinated for unison of speed of operation so that the movable floor is not subjected to unnecessary bending or cracking stresses.

The construction of the movable floor of the present invention comprises a plurality of first box-like framing structures embedded amongst a series of concrete slabs, with I-beams embedded in and supporting the concrete slabs, and connecting each first box-like structure to form the grid pattern described previously. Each first box-like structure includes lifting brackets which are adapted to engage a lifting plate which, in turn, is directly elevated and lowered by the lifting elements. The structural relationship between each first box-like element embedded in the movable floor is specifically adapted to transfer lifting forces around one of the first box-like elements to adjacent elements in the happenstance that the lifting element beneath the one box-like element experiences a failure. The first box-like elements in the movable floor each include corner brackets which hold a cover plate in place over the lifting plate and the first box-like elements when the movable floor is in use at any elevation.

The I-beams are attached to the first box-like elements in the movable floor in a manner which transfers the lifting force from the first box-like elements to the load bearing brackets attaching the I-beams to the box-like elements during the lifting and lowering operations. The I-beams each preferably have holes formed in the web structure to provide paths for intertwining rods which are used to suspend and support the concrete slabs.

A base floor extends beneath the movable floor and is provided with a plurality of second box-like framing structures surrounding the lifting elements. The second box-like elements correspond in size and vertical juxtaposition to the first box-like structures embedded in the movable floor. Each second box-like structure in the base floor provides support for the corresponding first box-like structure in the movable floor when the movable floor is in its lowermost position.

The dimensional relationship between each lifting plate and the corresponding lifting brackets on the first box-like elements surrounding each lifting plate is specifically designed whereby the corners of each lifting plate engage the underside of brackets during the elevating and lowering operation. By rotating each lifting plate forty-five degrees in either direction when the movable floor is completely lowered and there is no load on the lifting plates or lifting brackets, each lifting plate can be removed from its associated shaft which extends from, and is operated by, the lifting element in the base floor. In this manner, each mechanical lifting element is easily accessible for service. During normal elevating and lowering operations, one or two loosely fitting shafts or bolts extend through apertures in the lifting brackets adjacent the corners of each lifting plate to prevent the lifting plate from rotating away from its position beneath the lifting brackets.

The supporting shafts extending from the mechanical lifting elements preferably comprise screw back shafts which are driven vertically by means of a rotating internally threaded ring gear mating with external threads on the corresponding shaft. A motor and transmission system rotates the internally threaded ring gear upon command of a master control panel which ensures that each lifting element moves at the same speed and time. Rotation of the ring gear causes the shaft to move vertically, but without rotating. Since the threaded lifting shaft does not rotate, it is joined to a lifting plate by means of corresponding keys and keyways, thus enabling ease of removal of each lifting plate from its associated shaft when required for service or replacement. Further, since the shafts do not rotate relative to the lifting plates, no friction is generated between these two parts, reducing the risk of mechanical failure and enhancing the useful life of the entire structure.

The movable arena floor disclosed and claimed herein can be constructed in a relatively short period of time in most, if not all, presently constructed arenas. The movable floor, although it can be elevated or lowered to any height throughout the range of its minimum to maximum height, is particularly designed to support most expected loads that are normally encountered in arena showplaces in common use today. Due to the particular steel grid and concrete slab construction of the disclosed embodiment of the invention, loads are evenly distributed along the steel I-beams forming the grid, and then to the plurality of box-like elements, lifting brackets, lifting plates and mechanical lifting elements which comprise features of the present invention.

BRIEF DESCRIPTION OF THE DRAWINGS

The preferred embodiment of the invention will be described with to the accompanying drawings, wherein.

DESCRIPTION OF THE PREFERRED EMBODIMENT

The following description is of the best presently contemplated mode of carrying out the invention. This description is made for the purpose of illustrating the general principles of the invention, and is not to be read in a limiting sense. The scope of the invention is best determined with reference to the appended claims.

Figure 1:
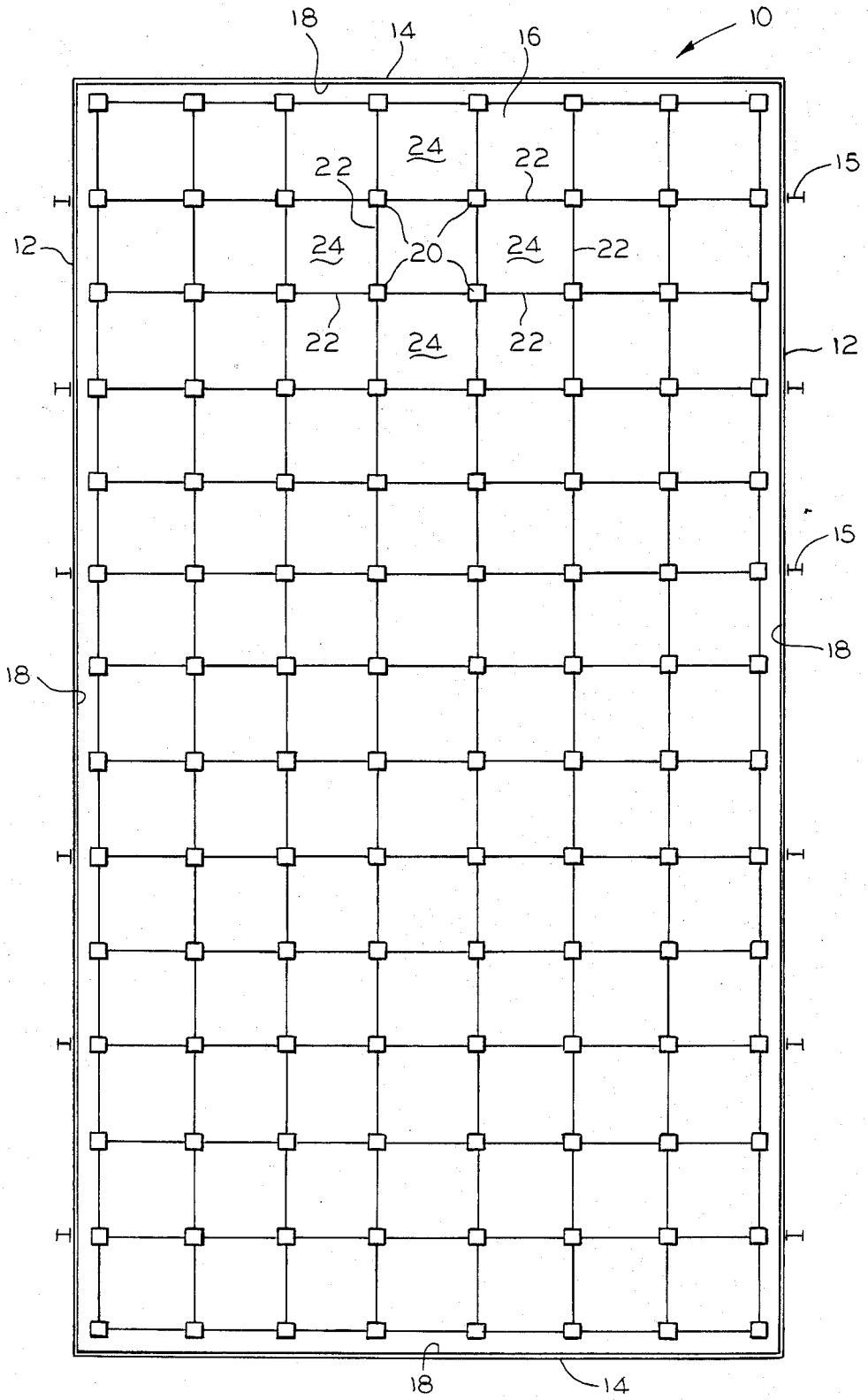
FIG. 1 is a top plan view of the grid pattern of the movable arena floor of the present invention, showing schematically the location of the box-like elements and beams embedded in the movable floor.

Referring to FIG. 1, the floor layout of a typical arena 10 is shown having a pair of side walls 12 extending upward from the horizontal plane of the floor, and a pair of end walls 14 also extending upward from the horizontal plane of the floor. In the schematic illustration, the numerals 12,14 indicate the inside faces of the walls. The walls 12,14 are externally supported by vertically standing I-beams 15. The floor of the arena 10 is covered with a movable floor 16, the lateral boundaries of which are designated by the numerals 18. Movable floor 16 is situated above the base floor and original floor of the arena (neither shown in FIG. 1), and comprises a plurality of box-like framing elements 20 extending in a grid-like pattern throughout the floor, and interconnected by a system of beams 22, preferably steel and illustrated as I-beams in the preferred embodiment.

Box-like elements 20 and beams 22 are embedded in and situated between a plurality of concrete slabs 24. The top of each box-like element 20 is fitted with a cover plate (not shown in FIG. 1), the top of which is flush with the top of slabs 24 and the top of beams 22, thereby producing a flat floor surface. The grid pattern shown in FIG. 1 includes eight rows of fourteen box-like elements 20, for a total of one hundred twelve such elements forming the grid in floor 16. The number of box-like elements may vary according to the size of the arena and variations in load requirements for specific uses. However, a grid incorporating one hundred twelve box-like elements 20 will be used for the purpose of describing the present invention. Also, in the preferred embodiment, box-like elements 20 are disposed at sixteen foot centers, with a three to four foot overhang around the rim. However, depending upon the application and size of the arena, these dimensions may vary.

Figure 2:
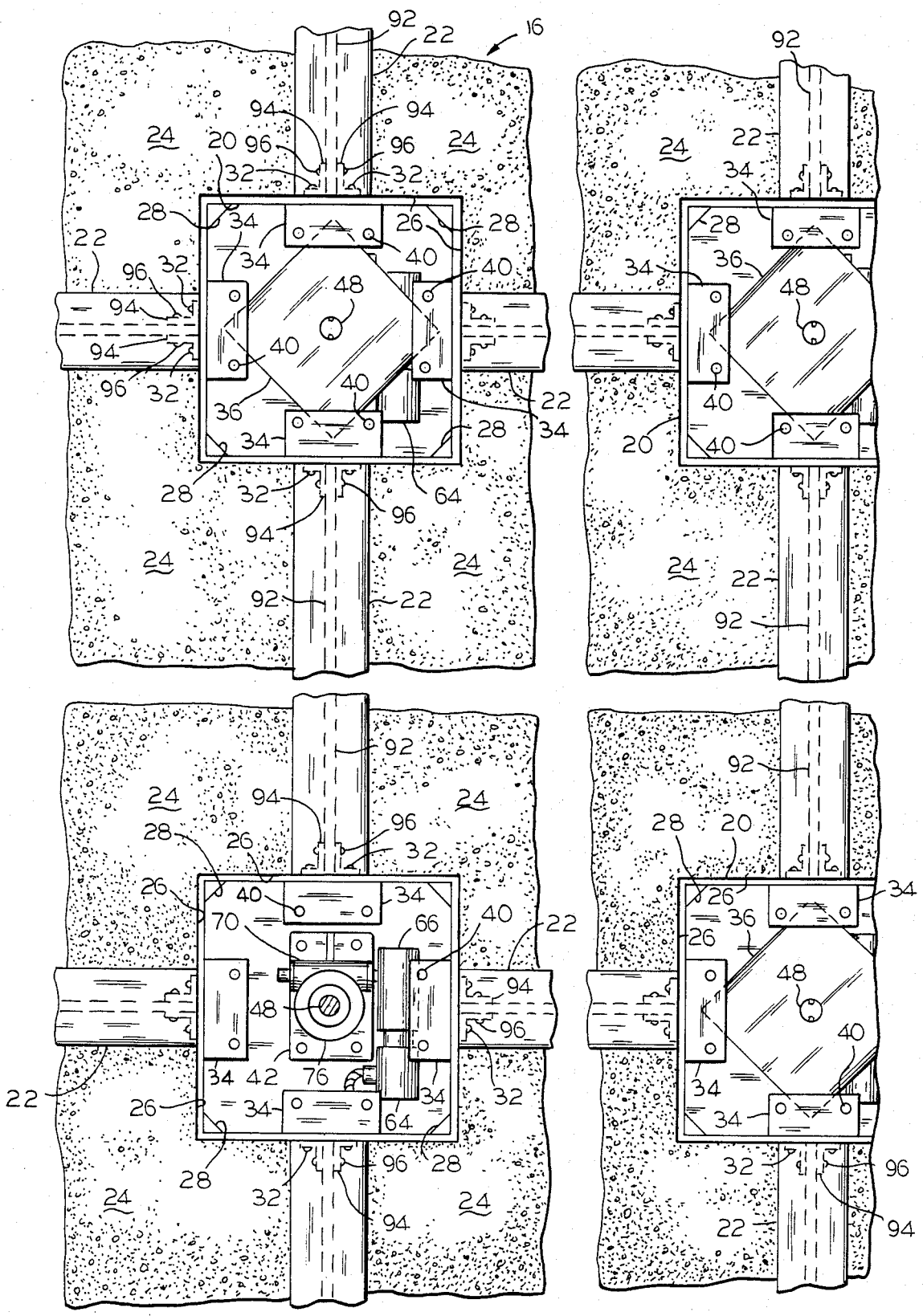
FIG. 2 is a detail top plan, partially broken away view of the movable arena floor structure of the present invention, shown in the lower left with certain elements removed to reveal the lifting elements embedded in the base floor beneath the movable arena floor.

FIG. 2 is a detailed view of the elements forming the grid construction of movable floor 16, wherein each box-like element 20 comprises four approximately similarly sized plates 26 embedded in a vertical position at the intersection of four flooring sections comprising concrete slabs 24. Although only one box-like element 20 will be described, it is to be understood that each of the one hundred twelve box-like elements of the preferred embodiment of the present invention are constructed substantially the same. Plates 26 are preferably made of steel, and are welded together at their corners to form box-like elements 20. Seats 28 are welded or otherwise suitably fastened near the top of each of the four corners of box-like element 20 to provide support for a cover plate 30 (FIG. 3), as will be explained.

Figure 3:
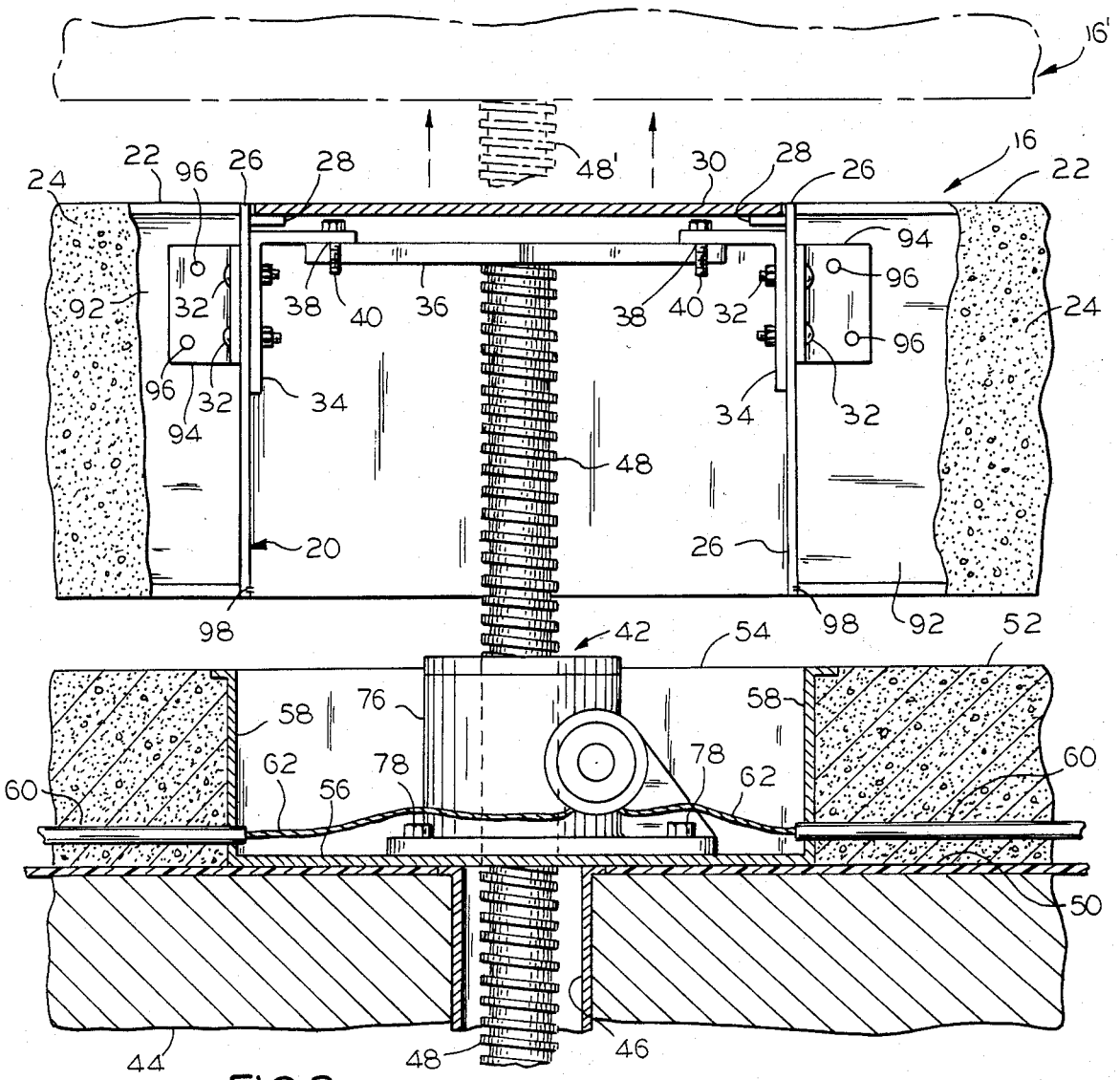
FIG. 3 is a cross-sectional elevation view of one of the elevating and lowering elements and of a portion of the movable arena floor of the present invention, showing the movable floor at two different elevations.

A pair of apertures (not shown) extend horizontally through each of the four plates 26 forming box-like elements 20. Bolts 32 extend through each aperture and attach angle plates or brackets 34 to each of the four plates 26, which brackets function as lifting means or load clips to ultimately support movable floor 16 in an elevated position, as will be explained. As best seen in FIG. 3, each angle plate 34 is L-shaped in cross section, with the vertical extension of the L being securely fastened to the side of corresponding plate 26 by means of bolts 32. The horizontal extension of each angle plate 34 extends towards the center of each box-like element 20, and is adapted to engage the upper surface of lifting plate 36 in a manner to be described. The horizontal extensions of some or each angle plate 34 in a given box-like element 20 include apertures 38 through which bolts or rods 40 loosely extend, as best seen in FIG. 3. Bolts 40 are adapted to act as lateral stops to prevent accidental rotation of lifting plate 36 when movable floor 16 is being raised or lowered. Bolts 40 are also easily removable to permit lifting plate 36 to be rotated and removed to provide access to the mechanical and electrical elements below the lifting plate for purposes of service or replacement.

Figure 4:
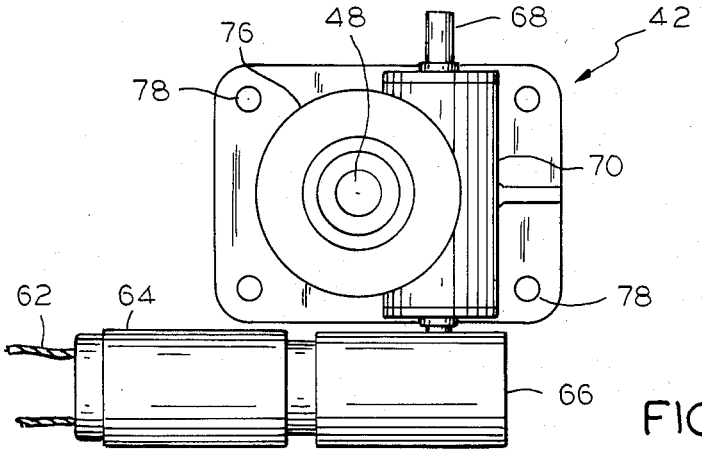
FIG. 4 is a top plan view of one of the lifting elements used in association with the present invention.

In the segment of movable floor 16 illustrated at the bottom left portion of FIG. 2, lifting plate 36 is removed, thereby revealing a plan view of lifting element 42, the details of which will be described with reference to FIGS. 2, 3 and 4. Referring in particular to FIG. 3, the original floor of the arena in which movable floor 16 is to be installed is designated by the numeral 44. A hollow shaft 46 is provided through the original floor 44, and is deep enough to house lifting screw shaft 48 with sufficient clearance between shaft 48 and the internal side walls of shaft 46 to prevent contact between the two.

The original floor 44 of the arena may be composed of concrete, cement, or other suitable material, and may or may not be covered by a surface 50 of some other suitable material, such as asphalt or the like. The present invention includes a base floor 52 comprised of concrete, cement, or similar suitable load-bearing material. Embedded in base floor 52 is a grid-like pattern of lower box-like framing elements 54 comprising horizontal base plate 56 and vertically extending plates 58. The top of each vertical plate 58 is flush with the upper extent of base floor 52, and each lower box-like framing element 54 is located beneath each box-like framing element 20 in the movable floor 16. Therefore, base floor 52 comprises a grid-like pattern of lower box-like elements 54 in somewhat the same configuration as shown in FIG. 1.

Figure 8:
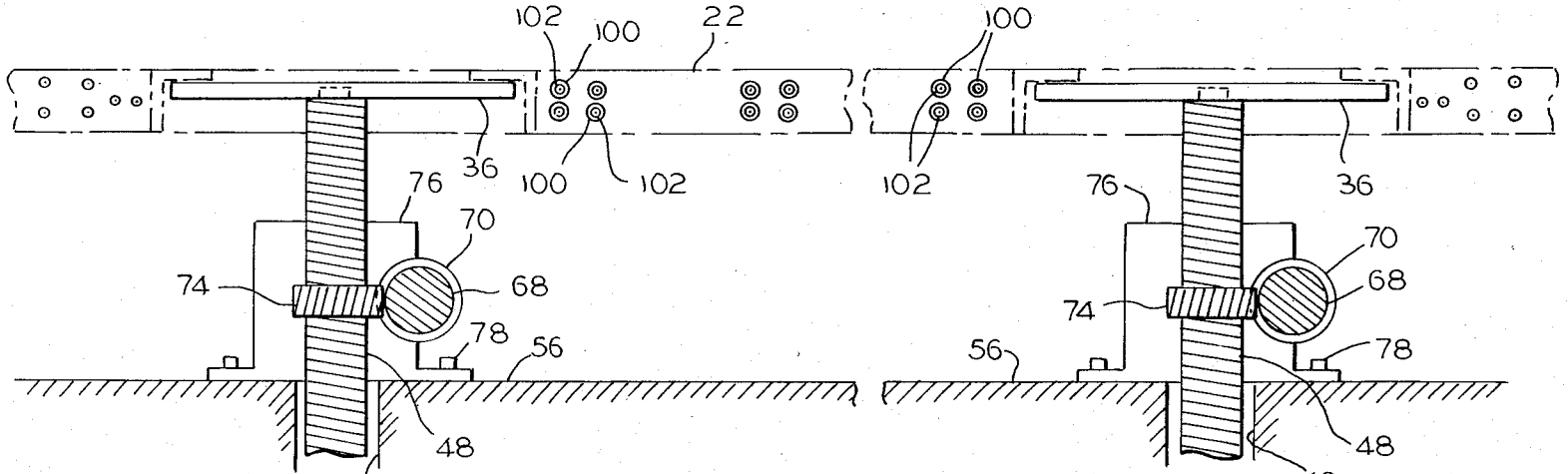
FIG. 8 is a schematic diagram in elevation showing the operation of two of the plurality of lifting elements used in the present invention.
Figure 9:
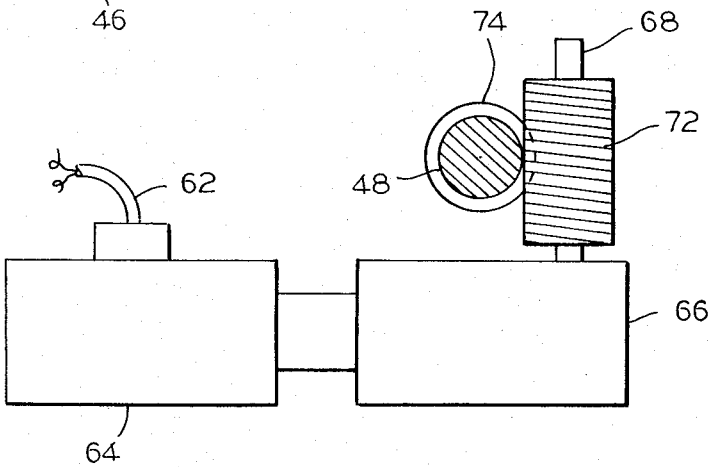
FIG. 9 is a plan schematic diagram illustrating the drive mechanism for the lifting elements utilized in the present invention.

Hollow conduits 60 are encased in base floor 52 and have electrical wires 62 extending therethrough. Conduits 60 extend between each of the lower box-like elements 54, and to a master conduit (not shown) in the base floor which carries electrical wires 62 to a master source of electric power and control (not shown). Wires 62 extend into each lower box-like element 54, and are connected to a motor 64 (FIG. 4) which forms part of and drives lifting element 42. Motor 64 is mechanically connected to a transfer case 66 which rotates shaft 68 extending axially through a housing 70. Referring to FIGS. 8 and 9, shaft 68 has a helix gear 72 centrally disposed thereon in the interior of housing 70, and helix gear 72 operatively meshes with a correspondingly threaded ring gear 74 which has a hollow central portion circumscribing lifting screw shaft 48 which extends through housing 76 of lifting element 42. The internal walls of the central portion of ring gear 74 comprise a screw threaded surface (not shown) which corresponds to and mates with the thread pattern on lifting-screw shaft 48. Thus, as motor 64 causes shaft 68 and helix gear 72 to rotate, ring gear 74 also rotates around lifting screw shaft 48, thereby causing lifting screw shaft 48 to raise or lower, without rotating.

Referring again to FIG. 3, housing 76 of lifting element 42 is mounted by means of bolts 78 to horizontal base plate 56 of lower box-like element 54. Lifting screw shaft 48 extends vertically from the top and bottom of housing 76, and is supported only by the interconnection between the external threads on shaft 48 and the corresponding internal threads on the central portion of ring gear 74. In the present environment, each particular lifting element utilized tests out to a twenty ton design load. In the preferred embodiment of the invention, movable floor 16 weighs approximately one thousand tons, thereby requiring approximately fifty 20-ton rated lifting elements to support the movable floor. Therefore, the use of one hundred twelve lifting elements in the preferred embodiment provides a load safety factor of more than two.

Figure 10:
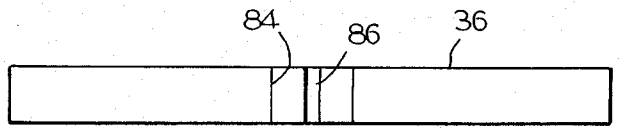
FIG. 10 is a detail exploded view of the key and keyway removable connection between the lifting plate and lifting screw shaft forming part of the present invention.
Figure 10:
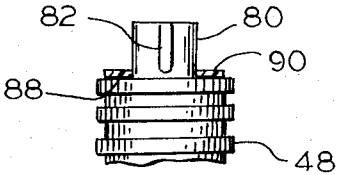

Referring to FIG. 10, the top of lifting screw jack 48 includes a narrow diametered unthreaded portion 80 having two oppositely disposed key elements 82 protruding laterally. Correspondingly, lifting plate 36 has an aperture 84 therethrough which is only slightly larger than the diameter of portion 80 of lifting screw shaft 48. The internal wall of aperture 84 includes two oppositely disposed keyways or slots 86 which are adapted to receive and mate with keys 82 when lifting plate 36 is mounted on top of shaft 48. When so mounted, the correspondence between keyways 86 and keys 82 prevents rotation of lifting plate 36 relative to shaft 48, and permits lifting plate 36 to be readily installed on and removed from shaft 48. When lifting plate 36 is mounted on shaft 48, the underside of lifting plate 36 adjacent aperture 84 rests on shoulder 88 of lifting screw shaft 48, thereby providing support for the lifting plate. In an alternate embodiment of the present invention, hardened support washers 88 are placed on shoulder 90 to support lifting plate 36 and distribute the load in a more advantageous manner.

Referring to FIGS. 2 and 3, lifting plate 36 extends laterally from its junction with lifting screw shaft 48 until the corners of the lifting plate extend beneath the underside of angle plates 34, and between bolts or rods 40. The lifting force provided by lifting element 42 and shaft 48 is transferred through lifting plate 36 and angle plates 34 to movable floor 16, as will be explained in more detail. Since heavy load forces are encountered during the operation of the present invention, the thickness of lifting plate 36 and of angle brackets 34, as well as the distance which each corner of lifting plate extends beneath its corresponding angle bracket, . are calculated to provide the necessary load strength when movable floor 16 is elevated. In a preferred embodiment of the invention, lifting plate 36 is a steel plate one and one-fourth inches thick and seventeen and one-half inches square. Angle plates 34 are made from steel plate five inches by five inches, and three-quarter inches thick. The corners of each lifting plate 36 extend more than halfway past the inner edge of each angle plate 34 to provide sufficient contact area between the top of lifting plate 36 and the bottom of angle plates 34 to adequately support movable floor 16.

An I-beam 22 is connected to the approximate lateral midpoint of the vertical plates 26 which form each of the box-like structures 20 in movable floor 16. As seen in FIG. 1, each I-beam 22 extends between two box-like elements 20 to form the illustrated grid pattern, and is attached to each box-like element 20 in a similar manner. Referring to FIG. 3, the vertical web 92 of each I-beam is straddled at its ends by a pair of angled mounting brackets 94 which are securely fastened to I-beam 22 by means of bolts 96 extending through one extension of mounting brackets 94. The other extension of mounting brackets 94 faces perpendicular to the longitudinal axis of its associated I-beam 22, and abuts flush against the outward face of corresponding plate 26. Bolts 32 extend through apertures (not shown) in the other extension of mounting bracket 94, and hold the bracket and I-beam 22 securely against plate 26. It should be noted that, preferably, the bolts 32 utilized to fasten brackets 94 to plate 26 are the same bolts used to fasten angle brackets 34 to plate 26, thereby providing a direct connection from lifting plate 36 to I-beam 22. The bottom flange of each I-beam 22 is also welded to its associated plate 26 as at 98 (FIG. 3) to transfer the load bearing forces from angle plates 34 when lift plate 36 elevates movable floor 16. The top flange of each I-beam 22 is at the same height as the top of the corresponding plate 26 to which the I-beam is attached.

Each I-beam 22 includes a plurality of holes 100 (FIG. 8) drilled through its web 94, and concrete slabs 24 are formed between each I-beam, as best seen in FIG. 1. An intertwining rod 102 passes through each of the holes 100 and extends into the concrete forming slabs 24. This structure creates a composite action in the I-beams to suspend and support the concrete mesh, and permits flexibility between the beams so that each concrete slab and I-beam combination stands by itself as a structural unit. Also, as a result of the aforesaid construction, if one of the lifting elements 42 fails during operation, the I-beam 22 and box-like structure 20 of the present invention enables the load forces to be transferred through plates 26 of the box-like element 20 above a faulty lift element, and through other I-beams to adjacent box-like structures and lifting elements.

In the preferred embodiment of the present invention, slabs 24 are composed of a fiber mix concrete which is light weight, has high strength, and puts additional meshing into the grid system. This fiber mix concrete also aids in preventing the development of cracks. A typical fiber mix concrete which can be used in the preferred embodiment comprises six bags of Portland cement mixed with one and a half pounds per yard of concrete containing high strength glass fibers, plus sand, gravel, water and the usual admixtures used in concrete mixing to allow pouring and smoothing of the concrete slabs 24. It is to be understood that other suitable mixtures providing the same light weight, high strength, and increased meshing characteristics in the concrete slabs 24 may be utilized. The concrete adheres to and embraces the intertwining rods extending into the concrete through holes 100 in I-beams 22 (FIG. 8) to form a unitary strong structure which resists cracking.

During construction of the movable floor 16 and base floor 52 as described above, a mesh membrane (not shown) is installed between concrete slabs 24 and the concrete forming base floor 52. This prevents the two concrete masses from adhering when movable floor 16 is elevated for the first time following construction. After the movable floor is raised for the first time, the membrane may be removed.

Figure 5:
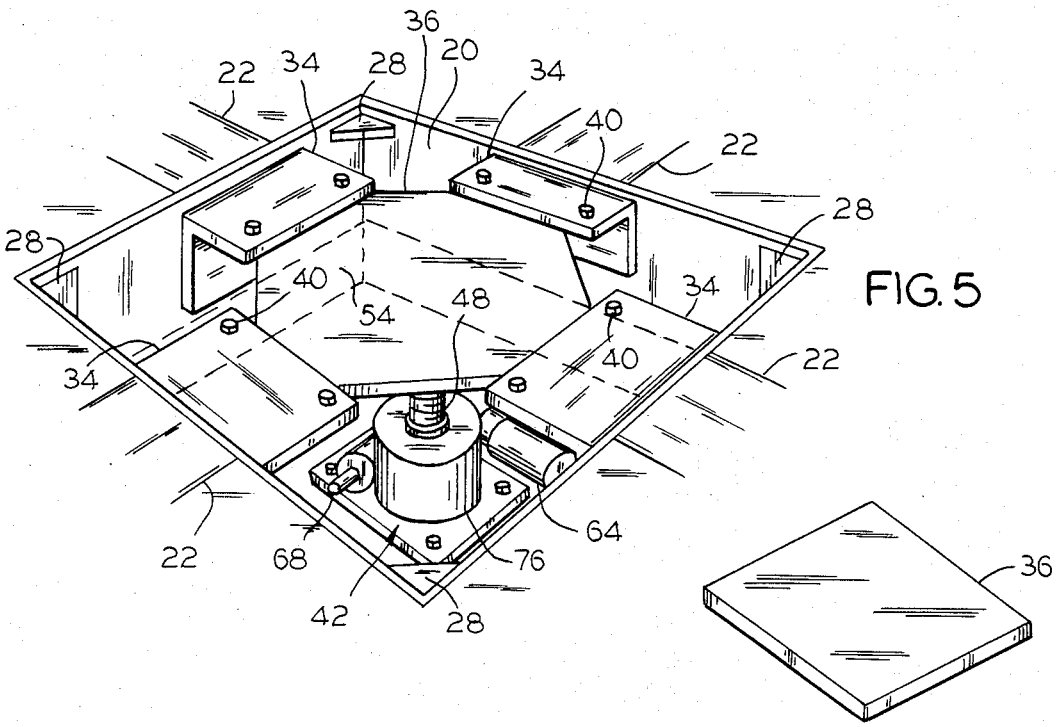
FIG. 5 is a perspective view of one of a first box-like structure embedded in the movable arena floor of the present invention, illustrating the mechanical relationship between the lifting plates, lifting brackets, and lifting elements forming part of the present invention.

In operation, it is initially assumed that movable floor 16 is in its lowermost position, wherein concrete slabs 24 and the lower flanges of I-beams 22 are resting on the top of base floor 52. The bottom edge of upper box-like elements 20 are resting either on base floor 52 or on the upper edges of vertically extending plates 58 which form lower box-like elements 54. As seen in FIG. 5, the four corners of lifting plate 36 extend beneath angle plates 34, and are prevented from accidentally rotating out of this position by means of vertically extending bolts or rods 40. As electrical energy is transmitted via wires 62 to the plurality of motors 64 forming part of the lifting elements, each helix gear 72 (FIG. 9) rotates and rotates each corresponding internally threaded ring gear 74. The corresponding rotation of the internal threads on ring gear 74 causes each lifting screw shaft 48 to move upward in a linear, non-rotating motion. In the preferred embodiment, lifting screw shaft 48 rises vertically at a rate of approximately two inches per minute.

Figure 7:
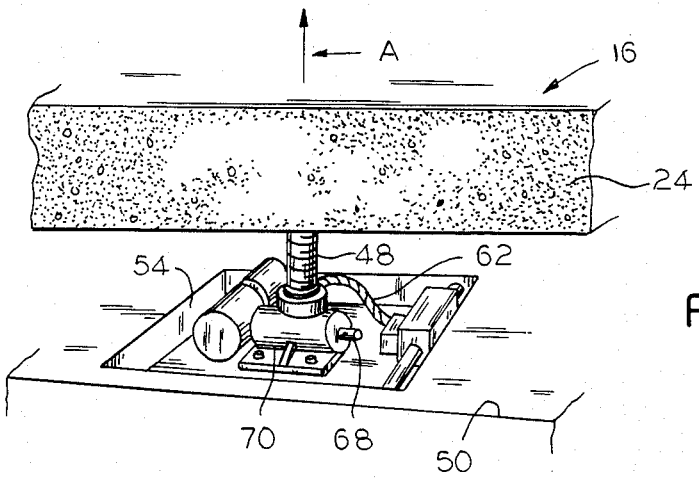
FIG. 7 is a perspective view of a lifting element partially elevating the movable arena floor of the present invention.

As lifting screw shaft 48 rises, the force applied to lifting plate 36 is transferred to angle plates 34; and then to box-like elements 20 and to I-beams 22 attached to each box-like element 20. The grid pattern illustrated in FIG. 1 distributes the lifting force from lifting elements 42 uniformly between all of the box-like elements 20 and along each of the I-beams 22 to ultimately raise movable floor 16 to its desired height, as shown diagramatically in FIG. 7 by the arrow A. To lower movable floor 16 from any elevated height, the direction of motion of motors 64 and ultimately threaded screw shafts 48 is reversed, and the system works oppositely to the procedure just described.

Figure 6:
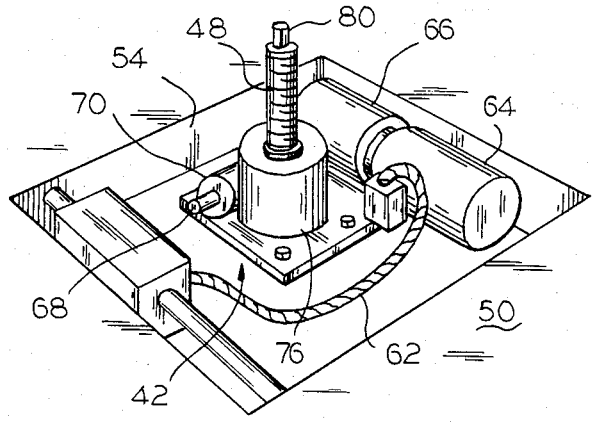
FIG. 6 is a perspective view of one of the second box-like elements embedded in the base floor, showing the lifting element and lifting plate raised to provide service access to the lifting element and associated mechanical and electrical features of the present invention.

To gain access to lifting element 42 for purposes of service or replacement, cover plate 30 (FIG. 3) is first removed from seats 28 of its associated box-like element 20 when movable floor 16 is at its lowermost position. This exposes lifting plate 36 and angle plates 34 directly to view. Lifting screw shaft 48 is then lowered to a position whereby compressive forces between lifting plate 36 and angle plates 34 are relieved. Bolts 40 are then removed from their respective apertures 38 in angle plates 34. Each lifting plate 36 is then manually rotated horizontally approximately forty-five degrees in either direction until each lateral edge of lifting plate 36 clears the adjacent inboard edge of angle plates 34. Plate 36 is then raised vertically off of the narrow diametered portion 80 of lifting screw shaft 48 (FIG. 6), thereby permitting free and open access to all components of lifting element 42. The keyway and key construction between lifting plate 36 and portion 80 of shaft 48, as illustrated in FIG. 10, permits the lifting plate to be readily removed and replaced without the use of tools.

To replace a previously removed lifting plate 36, the lifting plate is lowered until portion 80 of shaft 48 extends into aperture 84, and key 82 mates with keyway 84 (FIG. 10). Plate 36 is lowered until the underside of the plate adjacent and outboard of aperture 84 abuts shoulder 88. Then, with the upper surface of lifting plate 36 beneath the underside of each angle plate 34, plate 36 is rotated approximately forty-five degrees to either side, until each of the corners of plate 36 are beneath an angle plate 34, as best illustrated in FIG. 2. Bolts or rods 40 are replaced in apertures 38, and cover plate 30 is set in place on seats 28. The movable floor 16 is then prepared to be elevated to its desired height.

In a further embodiment of the present invention, not illustrated, the movable floor can be raised to a height of twelve to fifteen or more feet, providing ample space between the base floor and the underside of the movable floor, creating a new working space below the elevated movable floor surface. Thus, for example, additional exhibition space is provided where the movable floor is installed in an arena where trade shows are held.

In summary, the present invention comprises a novel construction for a movable floor for arenas and the like where the floor is subjected to heavy and variable loads, and where the movable floor itself constitutes a relatively heavy load. The unique grid structural relationship of the box-like elements, I-beams, and concrete slabs comprising the movable floor, as well as the novel means for transferring loads from the lifting elements to the physical structure of the floor, combine to produce a movable floor for an arena which can easily, rapidly, and safely be elevated to any desired height while supporting normal loads of sporting, entertainment, and other events at the desired height. Due to its unique design, each of the mechanical lifting elements incorporated into the present invention can be easily accessed through the box-like elements which form the grid-like structure of the movable floor.

I claim:

1. A system including the combination of a substantially unitized movable floor and lifting element means adapted to elevate and lower said moveable floor above the level of a stationary base floor wherein:

said movable floor includes a plurality of open-ended first box-like connecting elements having lifting bracket means attached to an inside surface of substantially rigid side walls forming said first box-like elements;

beam elements connected between adjacent first box-like elements on an outside surface of said side walls forming said first box-like elements to form a substantially unitized grid pattern of a plurality of similar sections comprising said beam elements on the sides thereof and said first box-like elements at the corners thereof;

flooring sections extending between adjacent beam elements and first box-like elements at the corners thereof forming said grid pattern, wherein the top level of said flooring sections, beam elements, and first box-like elements are at substantially the same height to form a substantially smooth movable floor surface;

said lifting bracket means attached to said beam elements and said first box-like elements; and lifting elements supported by said base floor, said lifting elements operatively connected to corresponding ones of said lifting bracket means whereby said lifting elements are adapted upon actuation to apply a lifting force to said lifting bracket means and elevate said movable floor to a pre-selected height above said base floor and to support said movable floor at said pre-selected height.

2. The combination of a movable floor adapted to be elevated and lowered by means of lifting elements above the level of a stationary base floor wherein:

said movable floor includes a plurality of first box-like elements having lifting bracket means attached to side walls forming said first box-like elements;

beam elements connected between adjacent first box-like elements to form a grid pattern comprising said beam elements and said first box-like elements;

flooring sections extending between adjacent beam elements and first box-like elements forming said grid pattern, wherein the top level of said flooring sections, beam elements, and first box-like elements are at substantially the same height to form a substantially smooth movable floor surface;

lifting elements supported by said base floor, said lifting elements operatively connected to corresponding lifting bracket means attached to said first box-like elements whereby said lifting elements are adapted upon actuation to apply a lifting force to said lifting bracket means and elevate said movable floor to a pre-selected height above said base floor and to support said movable floor at said pre-selected height;

said base floor including an upper surface;

a plurality of second box-like elements embedded in said base floor below the level of said upper surface;

a base plate forming the bottom of each second box-like element; and each of said lifting elements being supported by one of said base plates.

3. The combination of claim 2 wherein said second box-like elements are formed in a grid pattern throughout said base floor whereby each of said second box-like elements is substantially beneath a corresponding first box-like element of said movable floor.

4. The combination of claim 1 wherein said first box-like elements have a closed perimeter in horizontal configuration and are open ended in vertical configuration.

5. The combination of claim 1 wherein each lifting element comprises shaft means extending vertically therefrom, said shaft means adapted to be elevated and lowered by powered means forming part of said lifting element, lifting plate means removably attached to each said shaft means and extending laterally from the axis of said shaft means, each said lifting plate means extending beneath and engaging said lifting bracket means extending inwardly in spaced opposition to one another from opposite sidewalls of said box-like elements a predetermined distance.

6. The combination of claim 5 wherein said lifting plate means is removably attached to said shaft means by a key and keyway connection which enables said lifting plate means after rotation a predetermined amount to be vertically removed from and installed on said shaft means by clearance between said lifting bracket means.

7. The combination of claim 5 wherein the corners of said lifting plate means are spaced a distance in excess of said predetermined distance and are adapted to extend diagonally beneath said lifting bracket means.

8. The combination of claim 7 wherein said lifting plate means is adapted to be rotated approximately forty-five degrees in either lateral direction whereby said lifting plate means have a side-to-side dimension that permits it to be withdrawn from beneath said lifting bracket means, thereby permitting said lifting plate means to be removed from said shaft means.

9. The combination of claim 5 including removable rod means extending substantially vertically from said lifting bracket means, said rod means adapted to restrain said lifting plate means against horizontal rotation.

10. The combination of claim 1 wherein said beam elements are I-beams having web means extending between two flange means.

11. The combination of claim 1 wherein said flooring sections comprise concrete slabs extending between and adhering to said beam elements and said first box-like elements in the corners thereof.

12. The combination of claim 11 wherein apertures are provided in said beam elements to aid in holding said concrete to said beam elements and to create a composite action between said beam elements and said flooring sections which allows structural flexibility between said beam elements.

13. The combination of claim 1 wherein each of said first box-like elements includes seat means, said seat means adapted to support a removable cover plate within the perimeter of said box-like element, said cover plate having an upper surface which is disposed flush with the top of said beam elements, said first box-like elements, and said flooring sections to provide a continuous smooth surface for said movable floor when said cover plates are supported by said seat means.

14. The combination of claim 2 including an original floor beneath and supporting said base floor, aperture means in each said base plate of said second box-like elements, said aperture disposed substantially beneath a vertically disposed non-rotatable axially movable shaft which is elevated or lowered by each said lifting element, hollow shaft means disposed in said original floor beneath said aperture means and adapted to freely receive and house said vertically disposed movable shaft.

15. The combination of claim 1 wherein said beam elements and said first box-like elements are disposed in the structure of said movable floor to permit lifting forces to be carried from the beam elements, by an associated first box-like element, and to adjacent beam-like elements attached to said associated first box-like element in the happenstance that the lifting element operatively connected to said associated first box-like element fails.

16. The combination of claim 1 wherein said beam elements have holes therein, and intertwining rod means extending through said holes and into said flooring sections to suspend and support said flooring sections between said adjacent beam elements.

17. The combination of claim 16 wherein said flooring sections comprise concrete slabs, wherein said concrete includes high strength fibers dispersed throughout said slabs.

18. The combination of claim 17 wherein said beam elements have holes therein, and intertwining rod means extending through said holes and adhering to said adjacent concrete slabs, whereby said concrete adheres to and embraces said rods and beam elements to form a unitary, high strength movable floor which resists cracking.

19. The combination of a movable floor adapted to be elevated and lowered by means of lifting elements above the level of a stationary base floor wherein:

said movable floor includes a plurality of first box-like elements having lifting bracket means attached to saide walls forming said first box-like elements;

beam elements connected between adjacent first box-like elements to form a grid pattern comprising said beam elements and said first box-like elements;

flooring sections extending between adjacent beam elements and first box-like elements forming said grid pattern, wherein the top level of said flooring sections, beam elements, and first box-like elements are at substantially the same height to form a substantially smooth movable floor surface;

lifting elements supported by said base floor, said lifting elements operatively connected to corresponding lifting bracket means attached to said first box-like elements whereby said lifting elements are adapted upon actuation to apply a lifting force to said lifting bracket means and elevate said movable floor to a pre-selected height above said base floor and to support said movable floor at said pre-selected height;

each lifting element comprising shaft means extending vertically therefrom, said shaft means adapted to be elevated and lowered by powdered means forming part of said lifting element;

lifting plate means removably attached to each said shaft means and extending laterally from the axis of said shaft means, each said lifting plate means extending beneath and engaging said lifting bracket means;

removable rod means extending substantially vertically from said lifting bracket means, said rod means adapted to restrain said lifting plate means against horizontal rotation, wherein removal of said rod means permits said lifting plate means to be rotated horizotally and lifted vertically from said shaft means.

20. The combination of a movable floor adapted to be elevated and lowered by means of lifting elements above the level of a stationary base floor wherein:

said movable floor includes a plurality of first box-like elements having lifting bracket means attached to saide walls forming said first framing elements;

beam elements connected between adjacent first framing elements to form a grid pattern comprising said beam elements and said first box-like elements;

flooring sections extending between adjacent beam elements and first box-like elements forming said grid pattern, wherein the top level of said flooring sections, base elements, and first box-like elements are at substantially the same height to form a substantially smooth movable floor surface;

lifting elements supported by said base floor, said lifting elements operatively connected to corresponding ones of said lifting bracket means attached to said first box-like elements whereby said lifting elements are adapted upon actuation to apply a lifting force to said lifting bracket means and elevate said movable floor to a pre-selected height above said base floor and to support said movable floor at said pre-selected height;

said beam elements being I-beams having web means extending between two flange means; and mounting bracket means connected to each said web of each said I-beam and to each said first box-like element, each said mounting bracket means attaching its corresponding I-beam to said first box-like element adjacent said lifting bracket means, whereby lifting force is transmitted by said lifting elements through said lifting bracket means, through said first box-like element and to said I-beam through said mounting bracket means when said movable floor is elevated.

21. The combination of claim 20 wherein the bottom flange of each of said I-beams is fastened to its corresponding first box-like element to transfer additional load bearing forces to said I-beams from said lifting bracket means when said movable floor is elevated.

22. The combination of a movable floor adapted to be elevated and lowered by means of lifting elements above the level of a stationary base floor wherein:

said movable floor includes a plurality of first box-like elements having lifting bracket means attached to saide walls forming said first box-like elements;

beam elements connected between adjacent first box-like elements to form a grid pattern comprising said beam elements and said first box-like elements;

flooring sections extending between adjacent beam elements and first box-like elements forming said grid pattern, wherein the top level of said flooring sections, beam elements, and first box-like elements are at substantially the same height to form a substantially smooth movable floor surface;

lifting elements supported by said base floor, said lifting elements operatively connected to corresponding lifting bracket means attached to said first box-like elements whereby said lifting elements are adapted upon actuation to apply a lifting force to said lifting bracket means and elevate said movable floor to a pre-selected height above said base floor and to support said movable floor at said pre-selected height;

each lifting element comprising a vertically extending threading shaft supported by a rotatably driven ring gear means surrounding and threadingly engaging said threaded shaft, means to rotate said ring gear means in two directions causing said threaded shaft to raise or lower without rotation.

23. The combination of claim 22, wherein said means to rotate said ring gear comprises a motor forming part of said lifting element, said motor operatively connected to helix gear means, said helix gear means engaging corresponding and mating helix gear means fixed externally to said ring gear means, said ring gear means including internally disposed thread means adapted to engage external thread means on said threaded shaft.

24. The combination of claim 23 including electrical control means extending through said base floor and connected to each of said motors to provide selectively controlled operation of each of said lifting elements.

* * * * *